US005808635A

United States Patent [19]

Kneezel et al.

[11] Patent Number: 5,808,635

[45] Date of Patent: Sep. 15, 1998

[54] MULTIPLE DIE ASSEMBLY PRINTBAR WITH DIE SPACING LESS THAN AN ACTIVE PRINT LENGTH

[75] Inventors: Gary A. Kneezel, Webster; William R. Burger, Fairport; Steven R. Moore, Rochester; Michael Lo, Pittsford; Peter J. John, Rochester, all of N.Y.

[73] Assignee: Xerox Corporation, Stamford, Conn.

[21] Appl. No.: 643,677

[22] Filed: May 6, 1996

[51] Int. Cl.[6] ..... B41J 2/15

[52] U.S. Cl. ..... 347/41; 347/16; 347/43

[58] Field of Search ..... 347/16, 40, 41, 347/43

[56] References Cited

U.S. PATENT DOCUMENTS

| | | | |
|---|---|---|---|
| Re. 32,572 | 1/1988 | Hawkins et al. | 156/626 |
| 4,829,324 | 5/1989 | Drake et al. | 346/140 R |
| 4,908,638 | 3/1990 | Albosta et al. | 347/43 |
| 5,012,257 | 4/1991 | Lowe et al. | 347/43 |
| 5,160,945 | 11/1992 | Drake | 346/140 R |
| 5,192,959 | 3/1993 | Drake et al. | 346/140 R |
| 5,371,531 | 12/1994 | Rezanka et al. | 347/43 |
| 5,455,610 | 10/1995 | Harrington | 347/43 |
| 5,598,191 | 1/1997 | Kneezel | 347/40 |
| 5,598,192 | 1/1997 | Burger et al. | 347/40 |
| 5,684,517 | 11/1997 | Clemente et al. | 347/43 |

FOREIGN PATENT DOCUMENTS

| | | | |
|---|---|---|---|
| 595658 | 5/1994 | European Pat. Off. | B41J 2/15 |
| 608105 | 7/1994 | European Pat. Off. | B41J 2/21 |
| 6135007 | 5/1994 | Japan | B41J 2/21 |
| 6198916 | 7/1994 | Japan | B41J 2/21 |
| 6210906 | 8/1994 | Japan | B41J 2/525 |

*Primary Examiner*—Jeffrey L. Sterrett

[57] ABSTRACT

An ink jet printbar assembly is provided with a plurality of printhead die assemblies mounted on a single flat substrate. The printhead die assemblies are linearly aligned along the substrate length. Each die assembly includes a line of nozzles having the same active print length. The individual die assemblies are spaced from adjacent die assemblies such that the last functional nozzle on one end of a die assembly is spaced a distance which is less than the active print length from the first adjacent functional nozzle on the next adjacent die assembly.

7 Claims, 8 Drawing Sheets

MULTIPLE DIE ASSEMBLY PRINTBAR WITH DIE SPACING LESS THAN AN ACTIVE PRINT LENGTH

BACKGROUND OF THE INVENTION AND MATERIAL DISCLOSURE STATEMENT

1. Field of the Invention

This invention relates to ink jet printing, and more particularly to an improved ink jet printbar having a plurality of colinearly arranged die assemblies for use in printing in a scanning mode.

2. Description of Related Art

Thermal ink jet printing is one type of drop-on-demand ink jet system, wherein an ink jet printhead expels ink droplets on demand by the selected application of a current pulse to thermal energy generators, usually resistors located in capillary-filled, parallel ink channels. Thermal ink jet printheads typically include a heater plate that includes a plurality of resistive heating elements and addressing electrodes formed on an upper surface thereof and a channel plate having a plurality of channels, which correspond in number and position to the heating elements, formed on a base surface thereof.

Conventionally, most commercial ink jet printers are of the scanning type wherein a printhead module, typically one inch or less in width and containing a plurality of ink ejecting nozzles or jets, is mounted on a carriage which is moved in a scanning direction perpendicular to the path of motion of a recording medium such as paper. After each line scan by the printhead, the recording medium is advanced, and the printhead is scanned again across the medium. Printers such as the Xerox 4004, Canon Bubble Jet, and Hewlett Packard DeskJet printers all use a scanning printhead architecture. A color scanning printbar comprising four printheads is disclosed in U.S. Pat. No. Re. 32,572.

Pagewidth ink jet printers are known in the art which utilize one or more full page width arrays. In these pagewidth printers, a full line recording head is fixed in position adjacent to the path of the recording medium. Since there is no scan and rescan time, a much higher print speed (on the order of 10:1) is enabled. One full width print bar may be used for a black only system; additional color print bars may be added to enable a highlight or full color printer.

U.S. Pat. No. 5,192,959 discloses a pagewidth printer formed by the linear abutment of fully functional printhead die elements. The die elements are mounted on a common heat sink substrate having a thermal coefficient of expansion similar to that of the material of the die elements thus reducing any nozzle misalignment due to temperature excursions.

For the scanning type printer, it would be desirable to assemble two or more print die assemblies on a single substrate so as to increase the length (height) of the recording swath laid down during a carriage line scan. Such an architecture enables a higher throughput for black or color printing. In the Re. 32,572, referenced supra, each printhead die assembly is located on a separate substrate. Multiple printheads having independent substrates are difficult to align with each other and, once aligned, to maintain precise alignment. It would be desirable to mount two, three or four die assemblies on a common substrate thus increasing the recording swath length. From a manufacturing viewpoint, it is very difficult to provide a seamless array of channels, e.g., ensuring that the last channel of one die assembly is equally spaced from the first channel on the abutting die assembly.

In a typical manufacturing procedure, two or more printing die assemblies would be bonded along the straight front edge of a flat substrate. However, die assemblies typically do not have marking transducers which extend to the edge of the die.

It is known to mount die assemblies in a staggered relationship on a common substrate to obtain an overlapping nozzle orientation which enables a precise spacing between nozzles. U.S. Pat. No. 5,160,945 discloses this technique in the formation of a pagewidth printhead.

Copending U.S. application Ser. No. 08/316,339 assigned to the same assignee as the present invention, discloses a scanning type printer in which a printhead comprises a plurality of die assemblies mounted on a common substrate. The die assemblies are spaced from each other by some multiple of the length of each die assembly array of nozzles. In other words, the die assemblies are not butted together and are not separated by a die assembly length but rather are separated by either the length of an operative group of nozzles (the active print length) or a multiple thereof.

All of the above-identified references are hereby incorporated by reference. A disadvantage with the arrangement in the referenced coapplication is that the printing zone is undesirably lengthened increasing the difficulty of maintaining a flat recording zone. A further disadvantage resulting from the increased length of the writing printhead is that the effects of thermal expansion are increased commensurate with the increased length.

SUMMARY OF THE INVENTION

It is an object of the present invention to provide a scanning type printhead with a wide swath with increased printing throughput relative to what may be achieved using single die assemblies.

It is a further object to reduce the effects of thermal expansion of separate die assemblies which comprise the printhead.

It is yet another object to facilitate the alignment of the respective die assemblies.

It is another object of the invention to provide a recording swath with an optimum length with respect to maintaining a flat print zone.

In order to achieve the above objects, and to overcome the shortcomings detailed above, according to embodiments of the present invention, a scan carriage that reciprocates in a first direction includes a printhead having a plurality of die assemblies mounted on a common substrate so that the die assemblies are adjacent to each other in a direction perpendicular to the first direction in which the scan carriage reciprocates. The die assemblies simultaneously print swaths of information that are adjacent to each other in the direction perpendicular to the first direction. Each die assembly has a line of nozzles extending from near a first end to near a second end of the die assembly.

The total length of a recording swath is the combined total of the print swath from each die assembly. It is assumed, for purposes of the invention, that the die assemblies are not buttable; that is, the distance from the last functional nozzle to the respective nearby end of the die assembly is larger than one internozzle spacing. According to the invention, each die assembly is separated by a distance such that adjacent functional nozzles on adjacent die assemblies are separated by a distance which is less than the active print length of each die assembly. As a general example, one die assembly has N nozzles and records black. An adjacent die assembly has three group of nozzles, N/3 nozzles in each group, each group associated with a color. The active print length is ND, D being the nozzle pitch distance (typically 1/300 inch). The adjacent active nozzles on the two die assemblies are separated by a distance equal to the active length of the nozzle groups; e.g., ND/3. This general principle demonstrates the concept of providing an optimally wide print length suitable for a color printer while minimizing the length to minimize the effects of thermal expansion on the larger print length of the prior art (where the adjacent nozzles are separated by at least a full active print length or a multiple thereof) and to ensure that the recording zone on the recording medium is maintained in a flat orientation.

This colinearly spaced die arrangement produces a versatile printbar. The arrangement permits die assemblies on a single printbar to perform different functions, such as printing different colors or increasing resolution. Optionally, the die assemblies may have identical printing functions, for example to increase throughput of monochrome printing or plotting.

For color printing, the spaced arrangement according to embodiments of the present invention has several advantages. First, the chance of color inks mixing on the printhead face when the die assemblies are spaced apart is reduced when compared to butted die assemblies. Additionally, the spacing between the die assemblies provides for some drying time between swaths such that a die assembly does not immediately print over a previously printed area thereby inhibiting the tendency toward intercolor bleeding which would otherwise reduce print quality.

The printhead arrangement may, for example, be mounted on a carriage of an ink jet printer that is adapted for reciprocation across the surface of a recording medium, such as paper. The paper is stepped a predetermined distance each time a swath of information is printed by the plurality of die assemblies. The arrays of nozzle openings on each of the die assemblies in this configuration are substantially parallel to the direction of movement of the recording medium and substantially perpendicular to the direction of traversal of the carriage.

The printhead configuration of multiple die assemblies bonded to a single substrate which is scanned across the recording medium is particularly well suited for plotters in which the paper size is larger than standard office paper sizes. In this application, the overscan length required to allow each die assembly to print on the entire paper is small compared to the paper size.

The colinear spaced geometry also permits fast monochrome printing. For example, a printbar having four die assemblies in a colinear configuration will have four times the printing throughput at the same scan speed. The fast monochrome mode for a four die colinear printbar would print a swath simultaneously for the four die assemblies.

More particularly, the present invention relates to an ink jet printing apparatus comprising:

a scan carriage mounted for reciprocal movement in a first direction; and a printhead mounted on said scan carriage, said printhead including a substrate and a plurality of die assemblies mounted on said substrate, each die assembly including an array of nozzles N having the same active print length ND, D being the nozzle pitch, said die assemblies mounted on said substrate adjacent to each other in a direction substantially perpendicular to said first direction so that when said scan carriage moves in said first direction, said die assemblies simultaneously print swaths of information on a recording medium adjacent to each other in said direction substantially perpendicular to said first direction and wherein adjacent functional nozzles on said adjacent die assemblies are separated by a distance S which is less than said active print length.

BRIEF DESCRIPTION OF THE DRAWINGS

The invention will be described in detail with reference to the following drawings in which like reference numerals refer to like elements and wherein.

DESCRIPTION OF THE INVENTION

The term ink jet printing apparatus as defined in the specification and claims encompass all ink jet marking devices including but not limited to plotters, copiers, printers, labelers and facsimile machines.

The invention will be described with respect to a first embodiment in which two colinear, spaced-apart die assemblies are provided on a substrate. However, as will become apparent, the invention is not limited to this one embodiment. For example, three, four or more die assemblies may be provided on a common substrate. The printing apparatus can print in a single color or multi-colors (e.g., highlight color (usually black and red, green or blue) or process colors (cyan, magenta, yellow and black). The invention also is applicable to ink jet printing apparatus other than those that use thermal energy to control ink drop ejection. For example, an arrangement can be used in which droplets are continuously emitted while being electrostatically deflected towards or away from the image receiving medium. Additionally, while the preferred embodiment uses die assemblies having what is known as a "sideshooter" architecture, the invention is equally applicable to a printer employing a "roofshooter" architecture. The defining idea of this invention is a coplanar array of die on the same substrate, where one or more of the die has a potentially different function (e.g. it may be configured to shoot a different color ink or a different spot size) and where adjacent die nozzles on adjacent die assemblies are separated by less than an active die print length.

Figure 1:
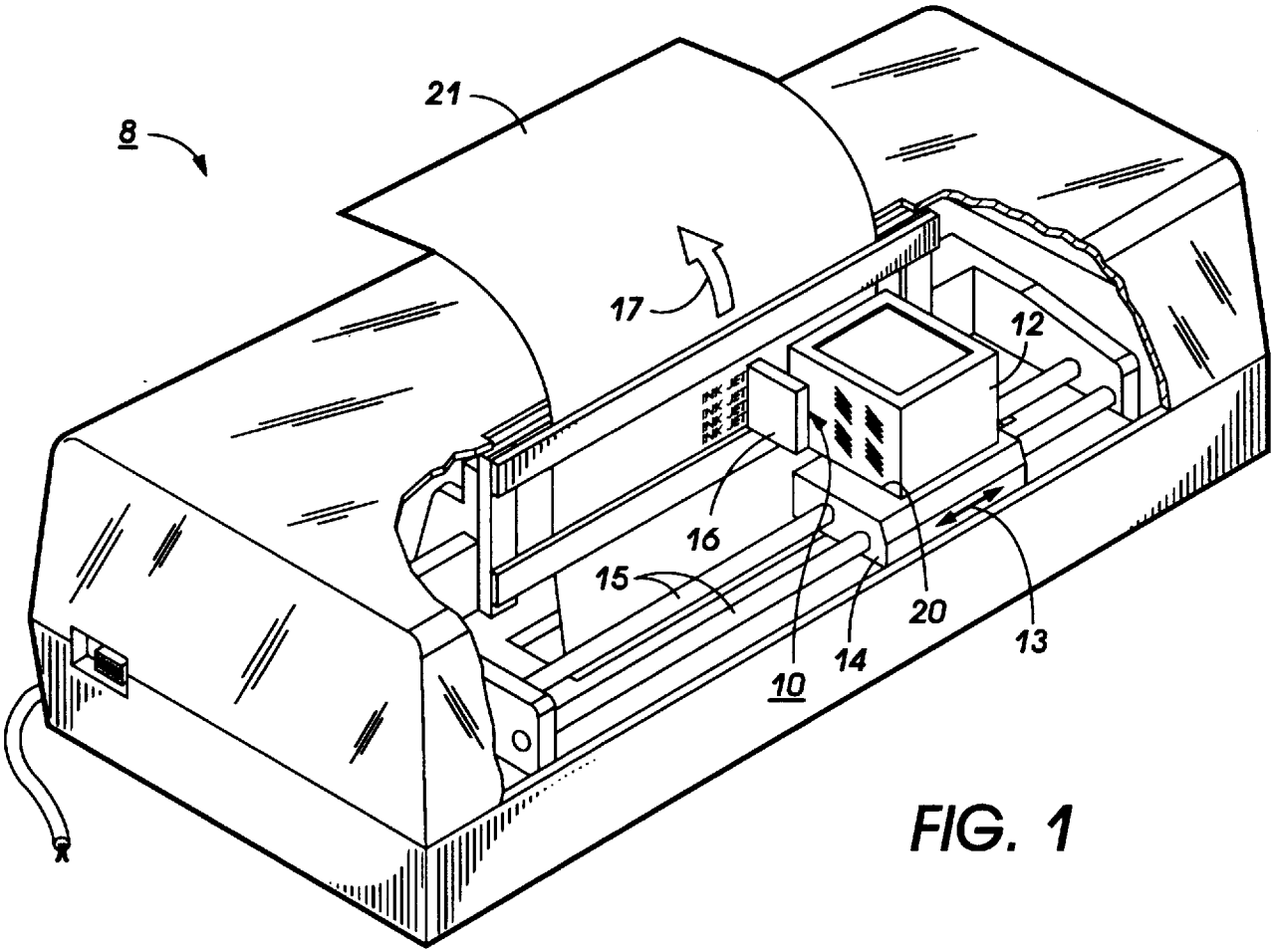
FIG. 1 is a schematic isometric view of a carriage type ink jet printing apparatus according to an embodiment the present invention.

A carriage type ink jet printing assembly 8 is shown in FIG. 1 and includes a printhead 10 according to one preferred embodiment of the present invention. An ink supply cartridge 12 is mounted on a reciprocating carriage assembly 14 that reciprocates back and forth in the direction of arrow 13 on guide rails 15. Printhead 10 comprises a single substrate 16 having two die assemblies 19, 20 (see FIG. 2) mounted thereon.

Figure 2:
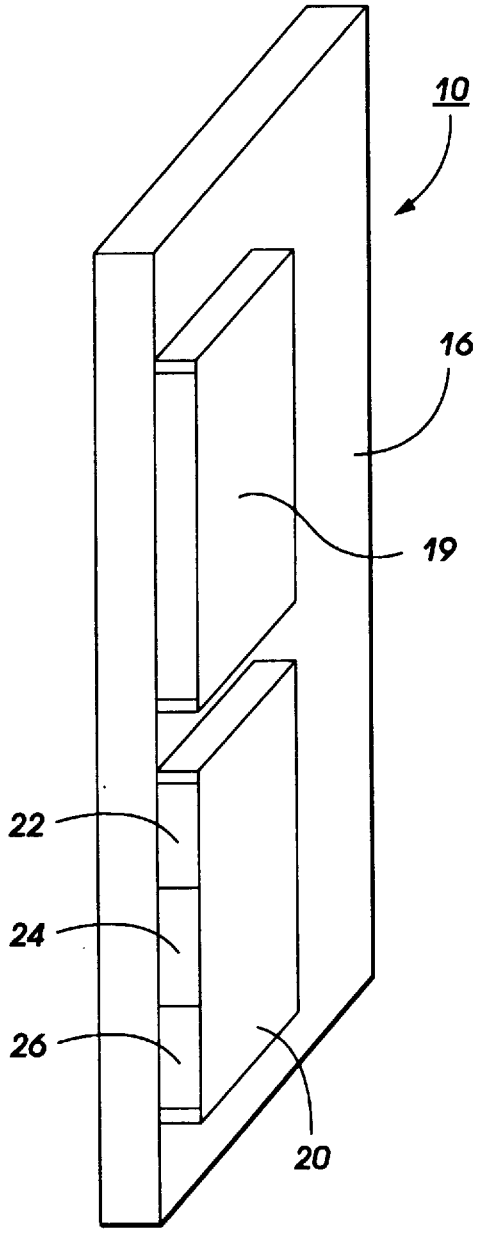
FIG. 2 is a front perspective view of the printhead shown in FIG. 1.
Figure 3:
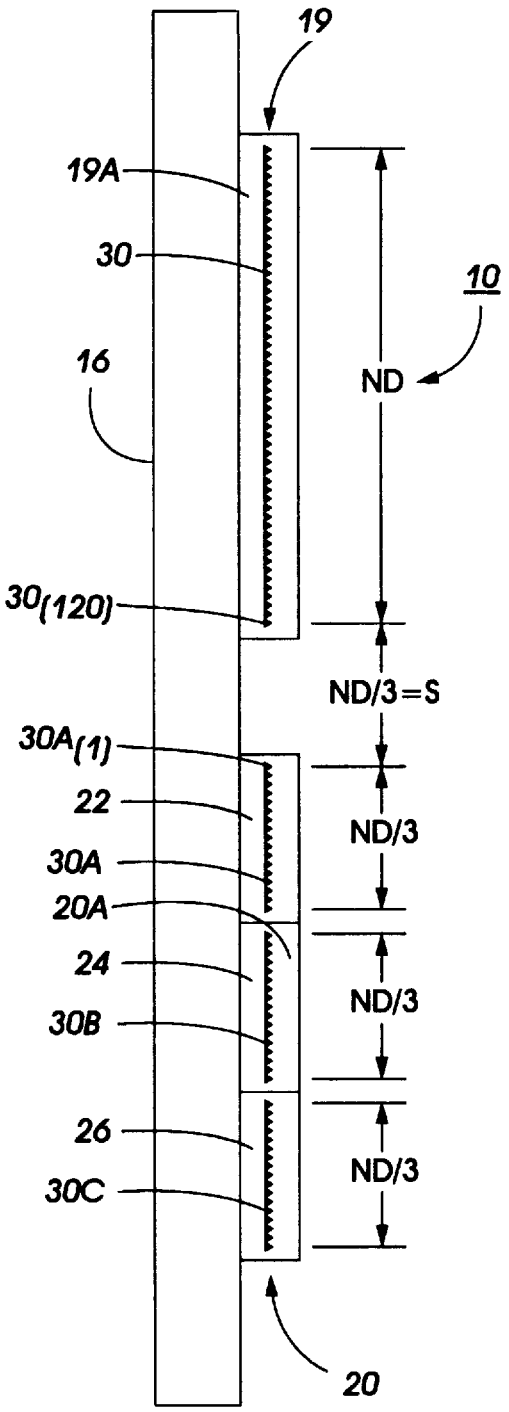
FIG. 3 is an enlarged front view of the printhead shown in FIG. 2 showing two die assemblies, one assembly having N nozzles and printing black; the second assembly having an N nozzles comprising three groups of N/3 nozzles, each group associated with a different color, the last active color nozzle of the first die separated from the first active nozzle of the second die by a distance less than the active printhead length, ND, D being the nozzle pitch.

Substrate 16 can be formed from low expansion materials such as silicon (a preferred material for the die assembly itself), aluminum nitride or graphite. Since the two die assemblies are separated (not directly butted together), the substrate 16 may be formed of materials that have coefficients of thermal expansion that differ from that of the die assembly materials. For example, metals, such as copper and aluminum, possess excellent heat sink and heat transfer properties. The die assemblies 19, 20 can be directly bonded onto substrate 16 using an adhesive material such as a silver-filled epoxy. Referring to FIGS. 2 and 3, each die assembly 19, 20 has a front (nozzle) face 19A, 20A, respectively. The front face 19A of die assembly 19, for this embodiment, has an array of N functional nozzles 30, the nozzles having an internozzle pitch distance D. The active print length for assembly 19 is ND and results in printing a swath of black ink onto a recording medium 21 (FIG. 1). Die assembly 20, with front nozzle face 20A, is segmented into three nozzle segments 22, 24, 26, each segment or group having an array of N/3 functional nozzles 30 which print, respectively, swaths of cyan, magenta and yellow ink onto recording medium 21. Each array of N/3 functional nozzles is one-third the active print length or ND/3. Die assemblies 19, 20, on substrate 16 thus comprise a color printhead 10. The ink is supplied to printheads 19, 20 by cartridge 12 (FIG. 1) which, as is known in the art, contains a plurality of reservoirs of colored ink (4 for this embodiment) which are conventionally supplied to the printhead nozzles. U.S. Pat. Nos. 4,829,324 and 4,961,281 provide disclosure for ink flow from cartridge to the printhead. These patents are hereby incorporated by reference.

As a specific example and referring to printhead 10 shown in FIG. 3, N=120. Therefore, the active print length is 120D. Each active die length of segments 22, 24, 26 of die assembly 20 contain an active die length shown as ND/3 or 40D. According to the present invention, die assemblies 19, 20 are spaced apart from each other such that the nearest adjacent functional nozzle of assembly 19 (nozzle $\mathbf{30}_{(120)}$) is spaced from the first functional nozzle of assembly 20 (nozzle $\mathbf{30A}_{(1)}$) by a distance which is less than the active print length. For this embodiment, the last nozzle $\mathbf{30}_{(120)}$ of die assembly 19 is spaced a distance of 40D/3 from the first functional nozzle $\mathbf{30A}_{(1)}$ of segment 22. This distance between the last and first functional nozzles of the adjacent die assemblies is also labeled S, for separation, in FIG. 3 for descriptive purposes, but it is understood that S is equivalent to the ND/3 length.

Referring to FIG. 1, it will be appreciated that, in operation, and when printing color documents, printhead 10 is printing four swaths during a single recording traversal by the carriage assembly 14. For the case of N=120, each swath will have a height of 40 nozzles (ND/3) with a spacing S in FIG. 3. The paper advance following each carriage recording scan would be equal to ND/3or a 40D spacing. The black printing would be done using one-third of the 120 nozzles 30 enabling use of the slow drying black ink in combination with fast drying color inks for improved black print quality without intercolor bleed.

The pulsing circuitry used to eject ink from the nozzles is conventional as disclosed in the referenced patents. Droplets of ink are expelled and propelled to the recording medium from openings in the line of nozzles 30, 30A, 30B, 30C in response to digital signals received by the printing device controller (not shown), which in turn selectively addresses the individual resistive heating elements (not shown), located in the printhead nozzles a predetermined distance from the nozzle openings with a current pulse. The current pulses cause an increase in temperature of printhead heating elements, vaporize the ink contacting the heating elements and produce temporary vapor bubbles to expel droplets of ink from the channel openings.

The embodiments of FIGS. 1–3 could also be used to print monochrome black documents, the recording medium advance being a complete active print length L of 120 nozzles resulting in a high throughput.

Figure 4:
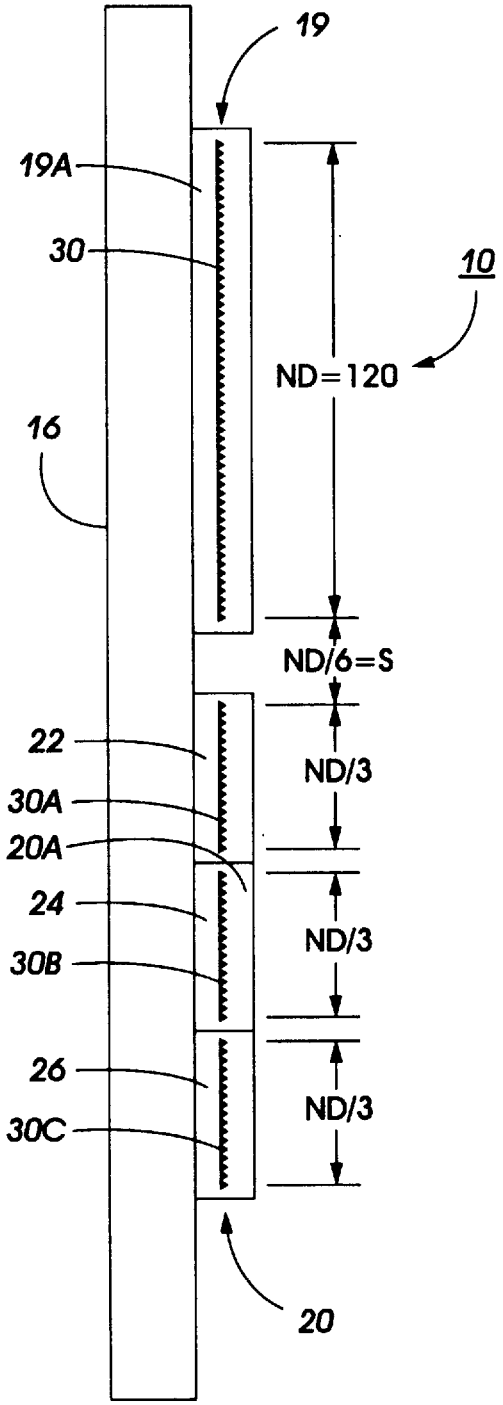
FIG. 4 is a variation of FIG. 3 with a shorter die separation.

The above description of a first embodiment establishes the general principle of the invention; the bonding of a plurality of die assemblies on a common substrate in a non-butting relationship, the actual distance separating the die assemblies being a function of the distance between the adjacent functional nozzles of each die assembly, that distance being less than the active die length. There are a variety of modifications which are consistent with the purposes of the invention. FIG. 4 shows a variation which can be used to randomize printing defects originating from particular nozzles. For this embodiment, the image may be printed using complementary checkerboard patterns from different sections of the printhead. The distance S is equal to ND/6, and the paper is advanced a distance ND/6 following each recording swath.

Figure 5:
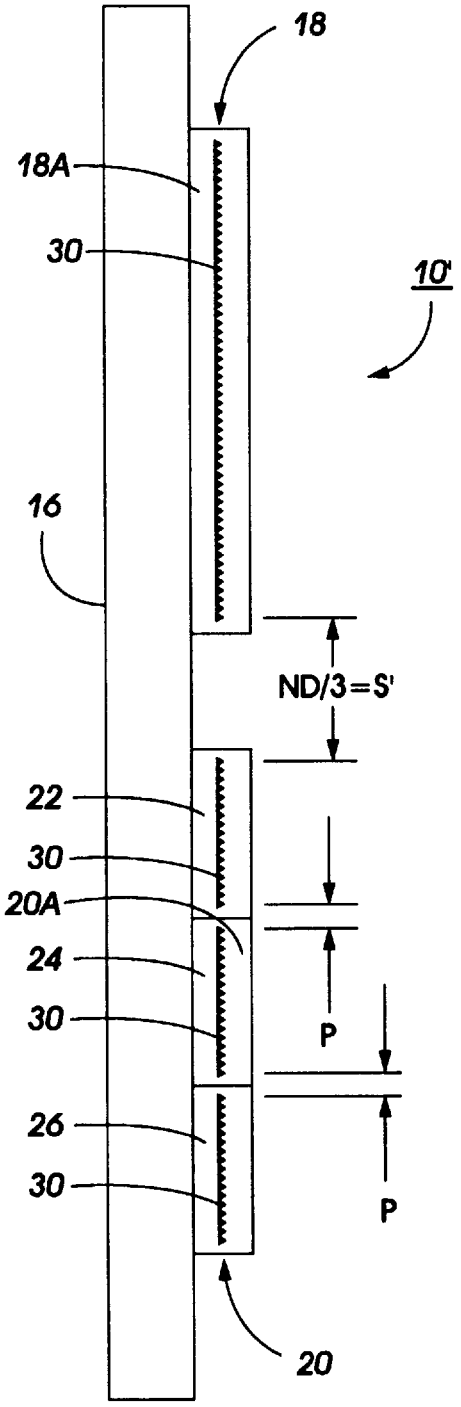
FIG. 5 is a variation of FIG. 2 wherein there is a non-recording separation between the color groups on the second die.

FIG. 5 shows an embodiment similar to FIG. 3 but printhead 10' is formed such that two non-printing spaces (equaling a distance p) are formed between adjacent active nozzles in segments 22, 24. These spaces, which are typically 1–4 nozzle pitch distances in length, minimize mixing of the colored inks on the printhead 10' face and prevent cross-contaminating nozzles near the color boundary. The optimal spacing S' for this embodiment would depend on the pixelling algorithm chosen to fill in the black spaces p.

Figure 6:
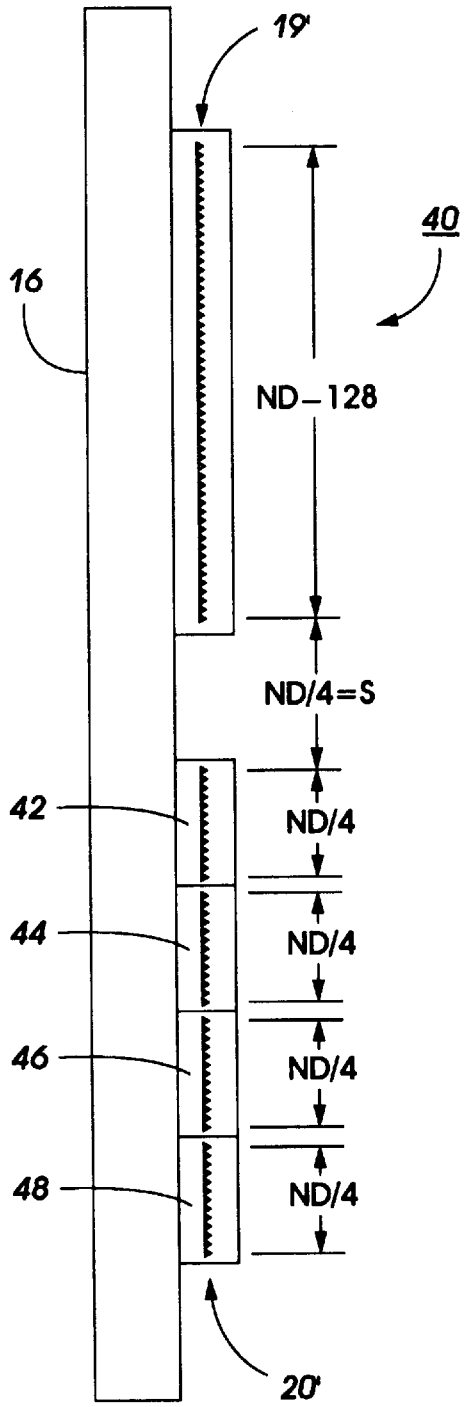
FIG. 6 is a variation of FIG. 2 in which the second die has four groupings of nozzles, one grouping of which prints black ink with different drying characteristics than the first die.

FIG. 6 is an embodiment which can be used for applications where it is desired to use both a fast drying black ink and a slower drying black ink. Printhead 40 comprises a die 19' having 128 nozzles and an active print length 128D for printing slower drying ink. Die 20' has four black nozzles segments 42, 44, 46, 48 each segment having 32 active nozzles for printing faster drying black, cyan, magenta and yellow inks, respectively. For this embodiment, S=ND/4=32D.

Figure 7:
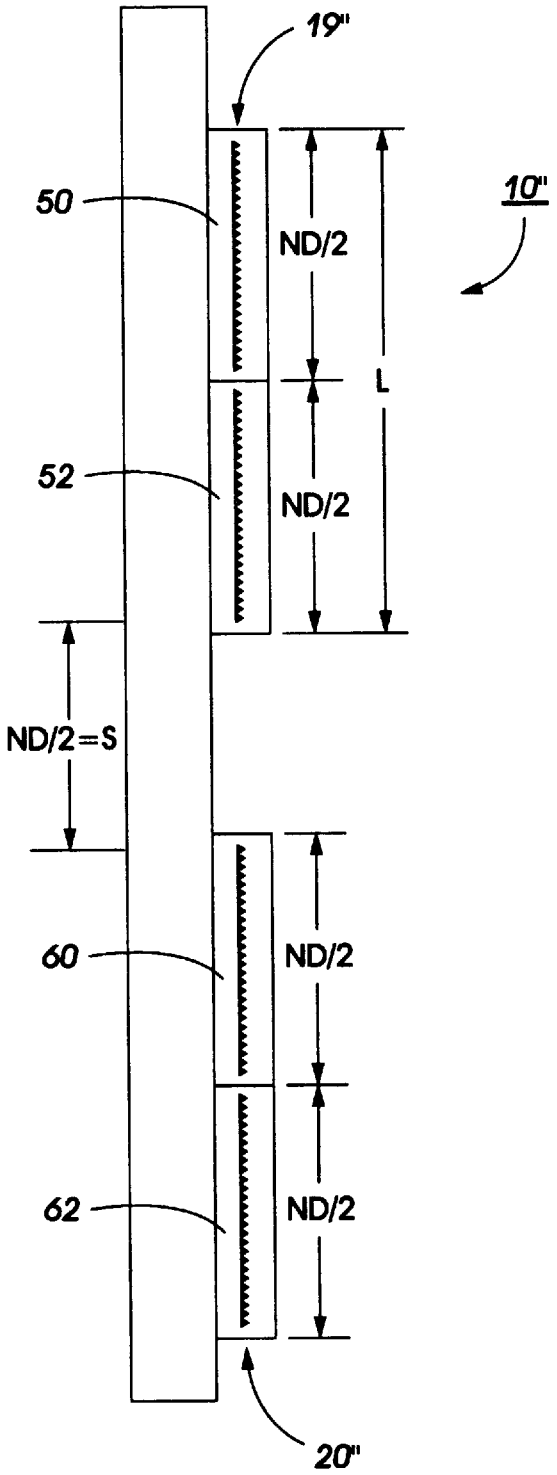
FIG. 7 is a variation of the FIG. 3 embodiment in which the first die has a black and color group of nozzles and the second die has two groups of color nozzles.

FIG. 7 is another variation of FIG. 3 where, for a printhead 10", both dies are segmented and one of the colors is transferred to die 19". Die 19" comprises two segments 50, 52. Segment 50 has 60 nozzles for recording with black ink, and segment 52 has 60 nozzles for recording with cyan ink. Die 20" has two segments 60, 62. Segment 62 has 60 nozzles for recording with magenta ink and segment 62 has 60 nozzles for recording with yellow ink. For this embodiment, S=ND/2=60D.

Figure 8:
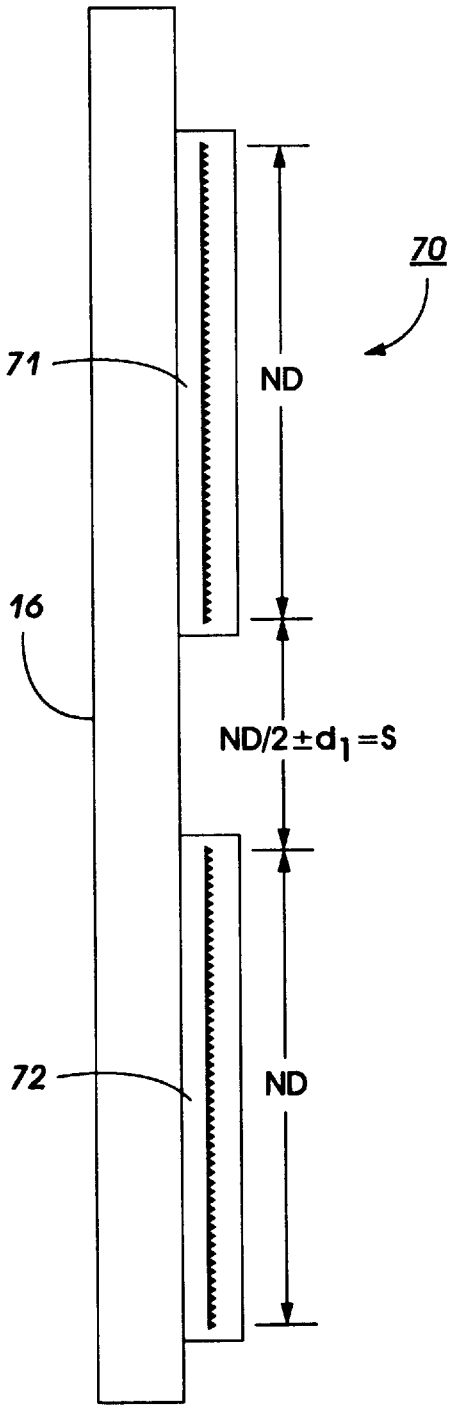
FIG. 8 is a variation of the FIG. 3 embodiment modified to increase recording resolution.

FIG. 8 is another embodiment of the invention wherein the length S is offset by a small distance to increase resolution in combination with a pixel printing algorithm.

A printhead 70 comprises two die assemblies 71, 72 mounted on substrate 16. Assemblies 71, 72 each having 128 nozzles and an active print length 128D nozzles printing black ink at a resolution of 300 spi. The spacing length S for this embodiment is ND/2 or 64D offset by a small distance $d_1$; for this embodiment, ½ D or 1/600 of an inch. To achieve monochrome 600 spi printing with this embodiment, the following recording medium stepping and printing technique is used. On the first left to right pass, print the pixels for the leading half of the first die to be brought past the paper. In particular, print those pixels corresponding to positions along the scan directions which correspond to timing pulses from a 300 spi timing fence (or encoder). Then advance the paper by half an active die length (ND/2=S). For a 128 jet 300 spi printhead, this would correspond to 0.2133". On the first right to left pass, print with all channels on the die 72, but print the pixels which correspond to interpolated 300 spi timing fence pulses (i.e. offset by 1/600 inch in the scan direction). Then advance the paper by half an active die length. On the second left to right pass, print with all channels on the die 72 corresponding to timing pulses from the 300 spi timing fence. At this point, the empty space between the two dies is now over the paper. The paper is advanced by half an active die length ND/2. On the second right to left pass, print with all channels on the die 72 and the first half of the channels on die 71 which is offset along the array direction by 1/600". Print the pixels corresponding to interpolated 300 spi timing fence pulses. Advance the paper by half an active die length. On the third left to right pass, print with all channels of both dies 71, 72, and time them corresponding to the timing fence pulses. Continue in this same fashion throughout the rest of the page. At the end of the page, in similar fashion, quit printing with halves of the die as the paper is advanced beyond them. Note that in this scheme, only a single unit of paper advance is required.

The invention has been described with reference to the preferred embodiments thereof, which are illustrative and not limiting. As one example, although each die assembly showed only one array of nozzles, an array can have a plurality of nozzle rows, sometimes arranged in staggered fashion. Also, the die assemblies may have unequal widths in the scan direction; e.g., unequal active print lengths. Many modifications and variations are apparent from the foregoing description of the invention and all such modifications and variations are intended to be within the scope of the claims.

We claim:

1. An ink jet printing apparatus comprising:

a scan carriage mounted for reciprocal movement in a first direction; and a printhead mounted on said scan carriage, said printhead including a substrate and a first and second die assembly mounted on said substrate, each die assembly including an array of nozzles N with a nozzle pitch D, said die assemblies mounted on said substrate adjacent to each other in a direction substantially perpendicular to said first direction so that when said scan carriage moves in said first direction, said die assemblies simultaneously print swaths of information on a recording medium adjacent to each other in said direction substantially perpendicular to said first direction and wherein said first die assembly has an active print length ND comprising two segments, each segment having an active print length ND/2 and each segment printing black and a first color, said second die assembly having an active print length ND comprising two segments, each segment having an active print length ND/2 and associated with printing a second and third color, and wherein adjacent functional nozzles on said adjacent die assemblies as separated by a distance S equal to ND/2, said apparatus further including means for moving said recording medium a distance of ND/2 following each movement of said carriage in said first direction.

2. An ink jet printing apparatus comprising:

a scan carriage mounted for reciprocal movement in a first direction; and a printhead mounted on said scan carriage, said printhead including a substrate and a first and second die assembly mounted on said substrate, each die assembly including an array of nozzles N with a nozzle pitch D, said die assemblies mounted on said substrate adjacent to each other in a direction substantially perpendicular to said first direction so that when said scan carriage moves in said first direction, said die assemblies simultaneously print swaths of information on a recording medium adjacent to each other in said direction substantially perpendicular to said first direction and wherein said first die assembly has an active print length ND, said second die assembly being divided in three segments, each segment having an active print length ND/3 and wherein adjacent functional nozzles on said adjacent die assemblies are separated by a distance S equal to ND/3, said apparatus further including means for advancing said recording medium a distance of ND/3 following each movement of said carriage in a first direction.

3. The apparatus of claim 2 wherein said first die assembly prints with black ink only along active print length ND and wherein each active print length of each of the three segments of the second die prints with an associated color.

4. The apparatus of claim 2 wherein said distance S is equal to an integral number of nozzle pitch distances D with S less than ND and wherein the recording medium advance distance following each movement of said carriage in said first direction is ND/3.

5. The apparatus of claim 2 wherein the active print length on adjacent segments are separated by a distance p and wherein said distance S is equal to ND/3±p.

6. An ink jet printing apparatus comprising:

a scan carriage mounted for reciprocal movement in a first direction; and a printhead mounted on said scan carriage, said printhead including a substrate and a first and second die assembly mounted on said substrate, each die assembly including an array of nozzles N with a nozzle pitch D, said die assemblies mounted on said substrate adjacent to each other in a direction substantially perpendicular to said first direction so that when said scan carriage moves in said first direction, said die assemblies simultaneously print swaths of information on a recording medium adjacent to each other in said direction substantially perpendicular to said first direction and wherein said distance S is equal to ND/3, said apparatus further including means for advancing said recording medium a distance following each movement of said carriage in a first direction.

7. An ink jet printing apparatus comprising:

a scan carriage mounted for reciprocal movement in a first direction; and a printhead mounted on said scan carriage, said printhead including a substrate and a first and second die assembly mounted on said substrate, each die assembly including an array of nozzles N with a nozzle pitch D, said die assemblies mounted on said substrate adjacent to each other in a direction substantially perpendicular to said first direction so that when said scan carriage moves in said first direction, said die assemblies simultaneously print swaths of information on a recording medium adjacent to each other in said direction substantially perpendicular to said first direction and wherein said first die assembly has an active print length ND associated with printing black ink of a first drying characteristic, said second die assembly being divided into four segments, each segment having an active print length ND/4 associated with printing black or color inks of a second drying characteristic and wherein adjacent functional nozzles on said adjacent die assemblies as separated by a distance S equal to ND/4; said apparatus further including means for moving said recording medium a distance of ND/4 following each movement of said carriage in said first direction.

* * * * *